US006412461B2

(12) United States Patent
Nakashima

(10) Patent No.: US 6,412,461 B2
(45) Date of Patent: Jul. 2, 2002

(54) VALVE RESTING MECHANISM FOR CYLINDER CONTROL TYPE ENGINE

(75) Inventor: Kenro Nakashima, Fujisawa (JP)

(73) Assignee: Isuzu Ceramics Research Institute Co. Ltd., Fujisawa (JP)

( * ) Notice: Subject to any disclaimer, the term of this patent is extended or adjusted under 35 U.S.C. 154(b) by 0 days.

(21) Appl. No.: 09/778,912

(22) Filed: Feb. 8, 2001

(30) Foreign Application Priority Data

May 11, 2000 (JP) ..... 2000-138018

(51) Int. Cl.[7] ..... F01L 13/00

(52) U.S. Cl. ..... 123/90.16; 123/90.39; 123/198 F

(58) Field of Search ..... 123/90.15, 90.16, 123/90.27, 90.39, 198 F

(56) References Cited

U.S. PATENT DOCUMENTS 4,556,025 A * 12/1985 Morita ..... 123/198 F
4,607,600 A * 8/1986 Yoshizaki ..... 123/90.16
6,058,895 A * 5/2000 Hermsen ..... 123/90.16
6,092,497 A * 7/2000 Preston et al. ..... 123/90.16
6,220,212 B1 * 4/2001 Wakeman ..... 123/90.16

* cited by examiner

*Primary Examiner*—Wellun Lo
(74) *Attorney, Agent, or Firm*—Staas & Halsey LLP

(57) ABSTRACT

A rocker arm for rocking on a rocker arm shaft is constructed to include two arms: a first rocker arm rocked positively by the rotating motion of a cam; and a second rocker arm for actuating the opening/closing actions of an intake/exhaust valve. At a running time of an engine at a high speed/under a high load, an electromagnet of an electromagnetic drive device is excited to move a movable pin forward thereby connect the first and second rocker arms to each other. At a running time of the engine at a low speed/under a low load, on the other hand, the electromagnet of the electromagnetic drive device for a selected cylinder is unexcited so that the movable pin is returned to an initial position by the force of a return spring to disconnect the first and second rocker arms.

12 Claims, 7 Drawing Sheets

VALVE RESTING MECHANISM FOR CYLINDER CONTROL TYPE ENGINE

BACKGROUND OF THE INVENTION

The present invention relates to a valve resting mechanism for a multi-cylinder engine. More particularly, the invention relates to a valve resting mechanism for a cylinder control type engine, for retaining a proper running state for an engine load by resting the multiple cylinders partially according to the acting state of the engine.

Most of multi-cylinder engines of the prior art are run by feeding the fuel and air individually homogeneously to all the cylinders according to a load all over drive ranges because they are restricted on the mechanism of a valve actuating system.

In the valve actuating mechanism capable of performing a drive resting the cylinders partially or changing the valve timing, on the other hand, there is known (see for example Japanese patent application Kokai publications No. 6-299828 and No. 7-49016) a valve actuating mechanism for the engine to make it easy to return from the partially rested run to the run with all the cylinders being active or to change the valve timing.

SUMMARY OF THE INVENTION

In the multi-cylinder engine of the type in which the fuel and air are fed individually homogeneously to all the cylinders in accordance with the load all over the drive ranges, however, the combustion efficiency at an idling time or at a low speed/under a low load is generally so poor as to increase the pumping loss thereby to raise a problem that the thermal efficiency is lowered. On the other hand, the valve actuating mechanism of the engine, as disclosed in Japanese patent application Kokai publication No. 6-299828, has such a complicated mechanism as to raise another problem that its assembly and control are troublesome.

An object of the invention is to solve the above-specified problems and to provide a valve resting mechanism for a cylinder control type engine, which can improve the combustion efficiency at the idling time and at the low speed/under the low load and can simplify the valve actuating mechanism of the engine.

In an overhead cam engine comprising: a cylinder head fixed on a cylinder block having multiple cylinders; an intake/exhaust valve for opening/closing an intake/exhaust port formed in the cylinder head; and a cam type valve actuating mechanism disposed over the cylinder head for actuating the intake/exhaust valve for the opening/closing actions, the cam type valve actuating mechanism including: a cam formed on a camshaft made rotatable according to the rotation of the engine; and a rocker arm adapted to rock on a rocker arm shaft in accordance with the rotation of the cam, for giving the opening/closing actions to the intake/exhaust valve, according to an aspect of the invention, there is provided a valve resting mechanism for a cylinder control type engine, wherein the improvement resides: in that the rocker arm includes a first rocker arm and a second rocker arm for rocking independently of each other on the rocker arm shaft, the first rocker arm being adapted to rock when given the rotational motion of the cam, the second rocker arm being adapted to give the opening/closing actions to the intake/exhaust valve; in that the first and second rocker arms have individual engagement portions, with which a pin to be slidably moved by an electromagnetic drive device comes into engagement; and in that the rocking motion is transmitted from the first rocker arm to the second rocker arm in the engaged state where the pin is engaged by both the engagement portions whereas the rocking motion is not transmitted from the first rocker arm to the second rocker arm in the disengaged state where the pin is not engaged by the engagement portion of the second rocker arm.

One of the engagement portions formed on the first and second rocker arms is formed at the boss portion of the first rocker arm by a pin guide hole for guiding the pin slidably, whereas the other engagement portion is formed at the boss portion of the second rocker arm by an engagement hole to be engaged by the pin. Moreover, the pin is inserted at all times into the pin guide hole of the first rocker arm and is biased in a direction to come out of the engagement hole of the second rocker arm by a return spring which is arranged between the head of the pin and the boss portion.

The electromagnetic drive device includes: a movable element for sliding the pin in the axial direction; a stator for establishing an electromagnet; and a clearance between the movable element and the stator for regulating the sliding extent of the movable element in the axial direction.

The sliding stroke of the pin is controlled by the sliding extent of the movable element. The pin and the movable element are mutually slidable toward the center of the rocking fulcrum of the rocker arm from the sliding faces of the engagement portions. On the other hand, the pin rocks while engaging at all times with the engagement portion of the first rocker arm and is brought by the sliding motion of the movable element into rocking engagement with the engagement portions of both the first and second rocker arms.

The first rocker arm and the second rocker arm are provided with return springs so that they may rock while following the motions of the cam and the intake/exhaust valve at all times.

In this cylinder control type engine, valve resting mechanisms are provided separately to separate cylinders so that they can operate independently for separate cylinders, and the engagement or disengagement of the such mechanisms with or from the first rocker arm and the second rocker arm provided to each cylinder are controlled mechanism by mechanism according to the running state of the engine.

The stator of the electromagnetic drive device includes: a case fixed on the cylinder head through a bracket; a yoke arranged in the case; and an exciting coil arranged in the yoke. On the other hand, the electromagnetic drive device includes a permanent magnet midway of the iron core for forming a magnetic path so that the movable element may be self-retained.

With the valve resting mechanism for the cylinder control type engine being thus constructed, when the electromagnetic drive device is activated in response to the high speed/the high load of the engine, the pin slides and moves so that the first and second rocker arms can be connected to each other to open/close the intake/exhaust valve.

When the electromagnetic drive device for the cylinder selected is inactivated, on the other hand, the pin of the corresponding cylinder is returned to the initial position by the return spring so that the first and second rocker arms come into the disconnected state. Then, even if the first rocker arm rocks according to the rotation of the cam, the second rocker arm does not rock to rest the selected cylinder.

Therefore, this valve resting mechanism for the cylinder control type engine can control the valve drive and the valve rest simply with or without the drive of the electromagnetic drive device so that the responding speed of the drive control is better improved than that of the hydraulic valve resting mechanism of the prior art.

At the idling time or at the low speed/under the low load, moreover, the valve drive is partially inactivated to rest the cylinders partially so that the engine can be run with a proper number of cylinders to improve the combustion efficiency. According to the invention, therefore, the pumping loss can be lowered to improve the thermal efficiency. In this valve resting mechanism for the cylinder control type engine, moreover, the intake valve and the exhaust valve can be assembled and controlled separately for the individual cylinders so that they can cope with the various cylinder controls.

DESCRIPTION OF THE PREFERRED EMBODIMENT

Figure 1:
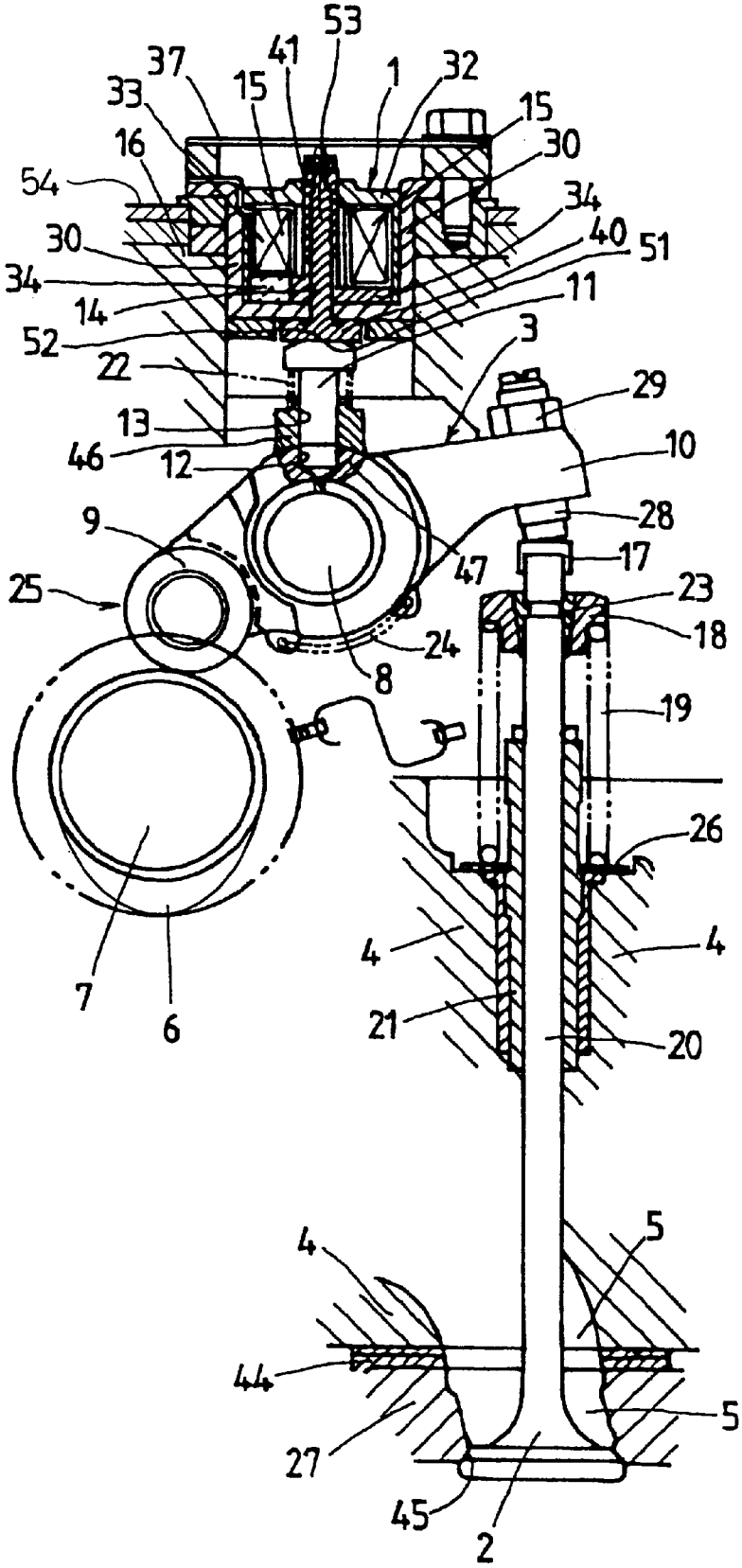
FIG. 1 is a schematic diagram of a valve resting mechanism of a cylinder control type engine according to the invention.

An embodiment of the invention will be described with reference to the accompanying drawings.

An overhead cam type engine having a valve resting mechanism according to the invention is constructed to include: a cylinder head 4 fixed in the (not-shown) cylinder block having multiple cylinders; an intake/exhaust valve 2 for opening/closing an intake/exhaust port 5 formed in the cylinder head 4; and a cam type valve actuating mechanism 3 formed over the cylinder head 4 for opening/closing the intake/exhaust valve 2. To the cylinder head 4, there is attached through a gasket 44 a cylinder head liner 27 forming a combustion chamber. In this cylinder head liner 27, there is formed a valve seat 45, on which the intake/exhaust valve 2 is seated. The reference numeral 54 denotes a cylinder head cover.

A valve stem 20 of the intake/exhaust valve 2 is reciprocated by the guide of a valve guide 21 which is arranged in a through hole formed in the cylinder head 4. At the end portion of the valve stem 20, there is fixed a cotter 23, to which a valve spring retainer 18 is attached. On the upper face of the cylinder head 4, there is disposed a valve spring retainer 26. Between these two valve spring retainers 18 and 26, moreover, there is arranged a valve spring 19 for returning the intake/exhaust valve 2 in a closing direction.

The cam type valve actuating mechanism 3 is provided with: a cam 6 formed on a camshaft 7 made rotatable according to the rotation of the engine; and a rocker arm 25 for rocking on a rocker arm shaft 8 in accordance with the rotation of the cam 6 to open/close the intake/exhaust valve 2. This cam type valve actuating mechanism 3 rocks the rocker arm 25 on the rocker arm shaft 8 in accordance with the rotation of the cam 6, and this rocking motion is transmitted through a valve adjusting screw 28, as attached to the leading end of the rocker arm 25, to a tappet 17 carried on the end portion of the valve stem 20, so that it is converted into a push-down motion of the tappet 17. By this push-down motion of the tappet 17, the opening/closing motion is transmitted to the intake/exhaust valve 2. Reference numeral 29 designates a nut for fixing the valve adjusting screw 28 on the rocker arm 25.

In the valve resting mechanism of this cylinder control type engine, the rocker arm 25 is constructed of a first rocker arm 9 and a second rocker arm 10 for rocking independently of each other on the rocker arm shaft 8 such that the first rocker arm 9 is rocked by the rotational motion of the cam 6 and such that the second rocker arm 10 opens/closes the intake/exhaust valve 2. On these first and second rocker arms 9 and 10, there are individually formed engagement portions to be engaged by a pin 11 which is slidably moved by an electromagnetic drive device 1. These engagement portions are characterized in that the rocking motion is transmitted from the first rocker arm 9 to the second rocker arm 10 in the engaged state where the pin 11 is engaged by both the engagement portions whereas the rocking motion is not transmitted from the first rocker arm 9 to the second rocker arm 10 in the disengaged state where the pin 11 is not engaged by the engagement portion of the second rocker arm 10.

Figure 3:
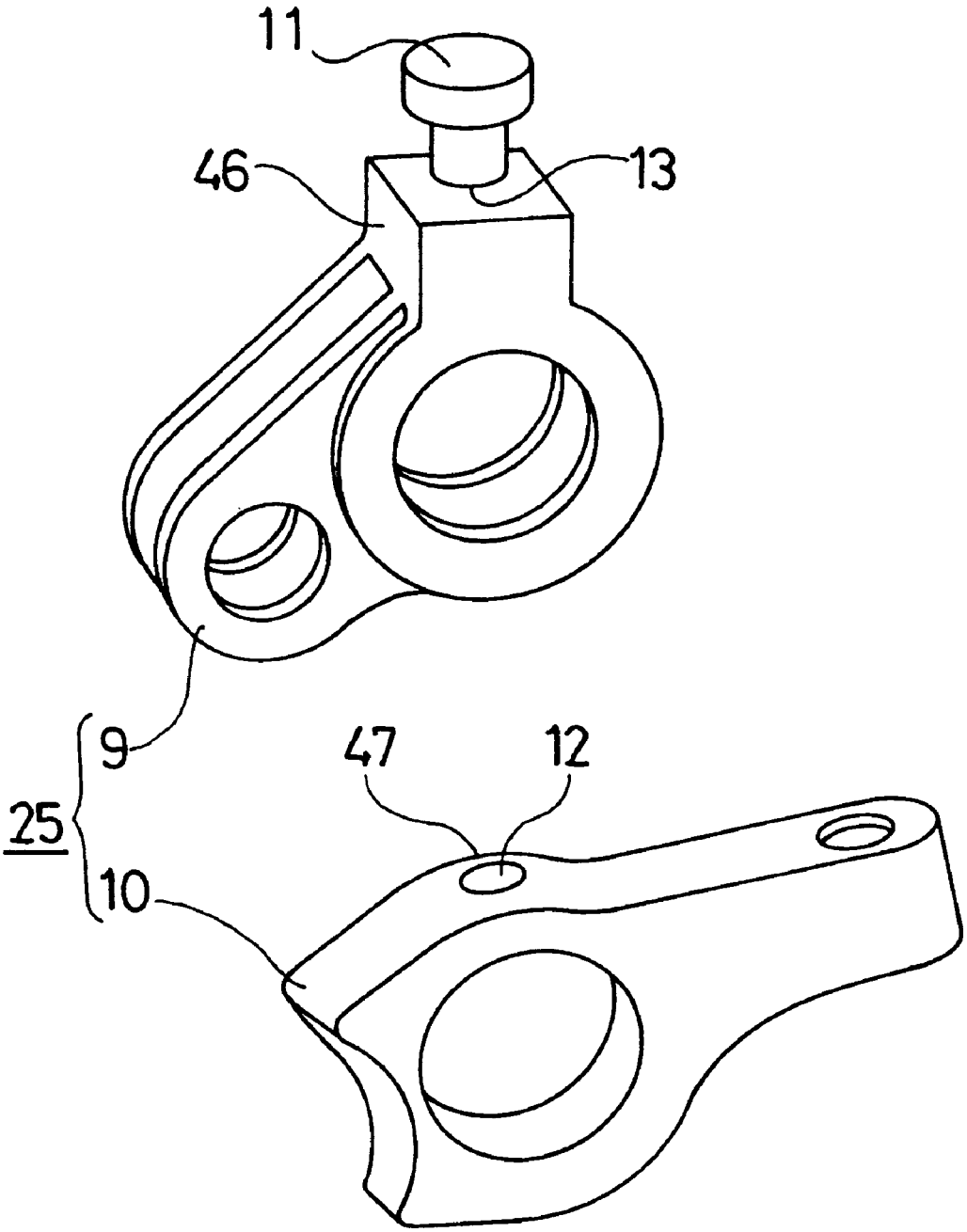
FIG. 3 is an exploded view of a rocker arm.

The engagement portion at the first rocker arm 9 is formed of a pin guide hole 13 which is formed in a boss portion 46 of the first rocker arm 9 for guiding the pin 11 slidably, as shown in FIG. 3. On the other hand, the engagement portion at the second rocker arm 10 is formed of an engagement hole 12 which is formed in a boss portion 47 of the second rocker arm 10 for engaging with the pin 11. On the other hand, this pin 11 is biased in a direction to come out of the engagement hole 12 of the second rocker arm 10 by a return spring 22 which is arranged between the head of the pin 11 and the upper face of the boss portion 46, as shown in FIG. 1.

Figure 2:
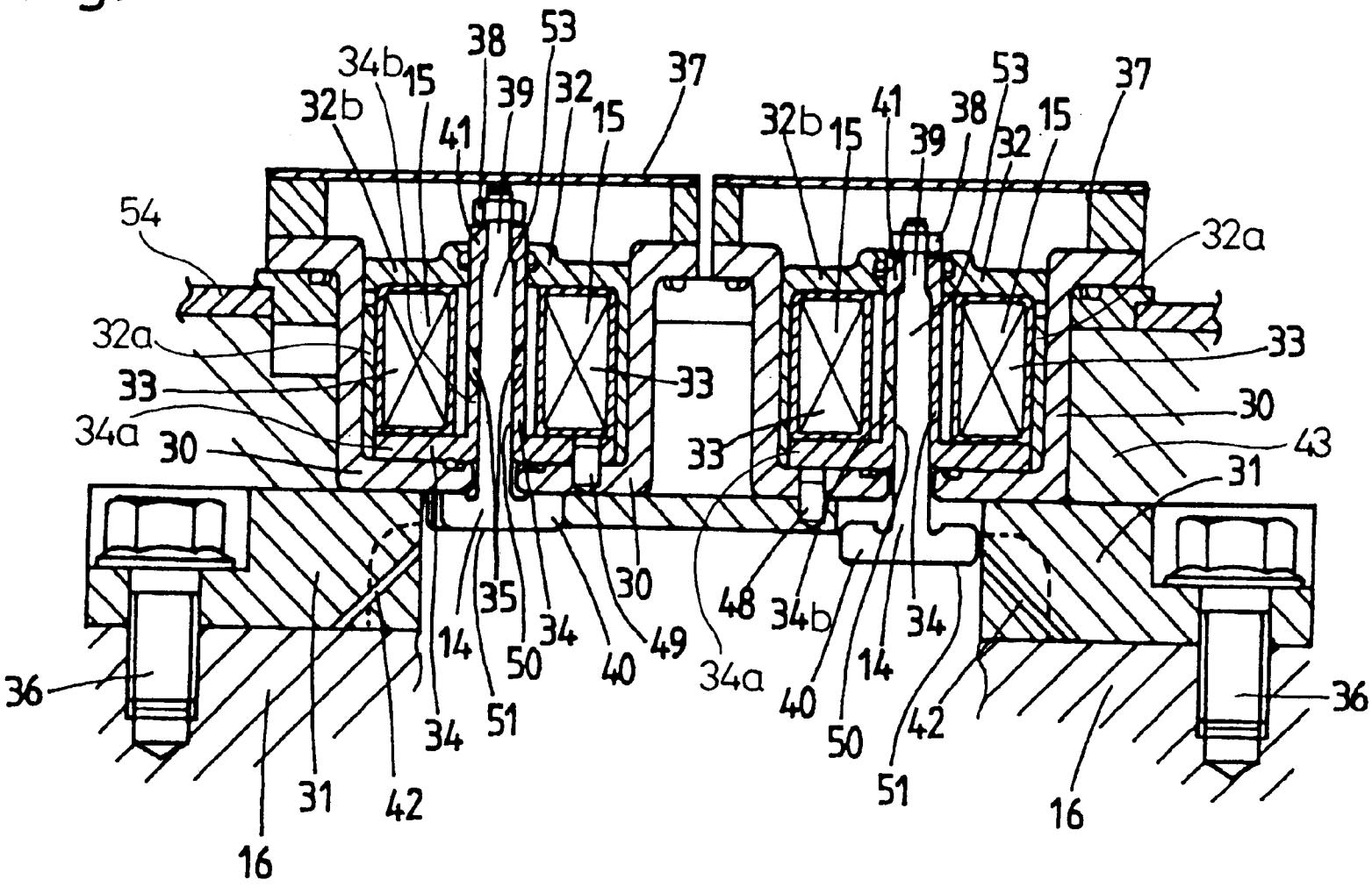
FIG. 2 is a sectional view of an electromagnetic drive device.

The electromagnetic drive device 1 includes: a movable element 14 for sliding the pin 11 axially; and a stator 15 for establishing an electromagnet, and has a clearance formed between the movable element 14 and the stator 15 for regulating the axial sliding extent of the movable element 14, as shown in FIG. 2.

The stator 15 is constructed to include: a case 30 fixed on the cylinder head 4 through a bracket 31; a lower yoke 34 and an upper yoke 32 arranged in the recess of the case 30 for forming a magnetic core; and an annular exciting coil 33 arranged concentrically in an annular portion defined by the upper and lower yokes 32 and 34. On the other hand, the movable element 14 is constructed to include: a plunger 53; a cylindrical plunger 41 fitted on the plunger 53 and fixed on the upper end portion 39 of the plunger 53 by a nut 38; and a push portion 40 formed at the lower end of the plunger 53.

The lower yoke 34 is formed of a bottom plate **34*a* and a cylindrical portion 34*b* erected on the bottom plate 34*a*, which has a hole formed to have a diameter equal to that internal diameter of the cylindrical portion 34*b*. On the other hand, the upper yoke 32 is formed of a cylindrical portion 32*a* and a cover portion 32*b* attached to the upper end of the cylindrical portion 32*a*. In the cover portion 32*b*, there is formed a hole, through which the cylindrical plunger 41** extends.

In the electromagnetic drive device 1, when the exciting coil 33 of the stator 15 is energized, the movable element 14 protrudes downward from a hollow portion 50 of the stator 15 so that the lower end face 51 of its push portion 40 comes into abutment against the upper end face 52 of the pin 11, as shown in FIG. 1, to push down the pin 11. This pin 11 has a sliding stroke controlled by the sliding extent of the movable element 14, that is, by the gap of a clearance 35 which is defined between a funnel-shaped end face at the upper end of the cylindrical portion 34*b* of the lower yoke 34 and a conical end face at the lower end of the cylindrical plunger 41. The pin 11 and the movable element 14 are mutually slidable toward the center of the rocking fulcrum of the rocker arm 25 from the sliding faces of the engagement portions. On the other hand, the stator 15 of the electromagnetic drive device 1 can be added after the assembly by attaching it to the bracket 31 supporting the rocker arm shaft 8 rotatably, as shown in FIG. 2, so that it can be assembled and controlled for each cylinder or for every intake and exhaust valves 2.

The pin 11 rocks always in engagement with the pin guide hole 13 of the first rocker arm 9, and the rocker arm 25 can rock when the pin 11 is slid into engagement with the engagement hole 12 of the second rocker arm 10 by the movable element 14. The first rocker arm 9 and the second rocker arm 12 are equipped with a return spring 24 so that they may rock at all times while following the motions of the cam 6 and the intake/exhaust valve 2. In short, the return spring 24 performs a function to cause the first rocker arm 9 to follow the cam 6.

The valve resting mechanism of this cylinder control type engine is provided for each cylinder so that it may act independently for each cylinder, and the engagement/disengagement of the first rocker arm 9 and the second rocker arm 10 of each cylinder are individually controlled according to the running state of the engine.

In the electromagnetic drive device 1, as shown in FIG. 2, the bracket 31 is fixed on a holding member 16 over the cylinder head 4 by means of bolts 36. On the bracket 31, there is fixed by a support bed 43 the case 30 which is fixed on the bracket 31 by means of a knock-pin 48. A cover 37 is attached to the case 30. in this case 30, there is fixed by means of a knock-pin 49 the lower yoke 34 of the electromagnet, which constructs the stator 15. On the lower yoke 34, there is fixed the annular upper yoke 32. In the annular portion defined by the upper yoke 32 and the lower yoke 34, there is arranged the exciting coil 33 which is arranged in an annular shape. In the hollow portion 50 of the stator 15, there is slidably arranged the plunger 53 which constructs the movable element 14.

The lower end face 51 of the push portion 40 of the plunger 53 forms the sliding face to come into sliding abutment against the pin 11. On the other hand, the clearance 35 is formed between the lower end face of the cylindrical plunger 41 and the upper end face of the lower yoke 34 so that it defines the stroke of the sliding motion of the movable element 14. As shown in FIG. 2, the lefthand movable element 14 is in the state where it is lifted by the exciting coil 33 energized, but the righthand movable element 14 is in the state where it is not lifted because the exciting coil 33 is deenergized. The bracket 31 has an oil filler port 42 for feeding a lubricant so that the movable element 14 may slide smoothly.

On the other hand, this valve resting mechanism of the cylinder control type engine could be constructed such that a permanent magnet is disposed midway of the upper yoke 32, i.e., the magnetic core for forming the magnetic path, although not shown, so that the movable element 14 may be self-restrained by the permanent magnet. In this modification, it is possible to reduce the power consumption at the time when the electromagnet is energized.

With the construction thus far described, this valve resting mechanism of the cylinder control type engine acts in the following manners.

Figure 4:
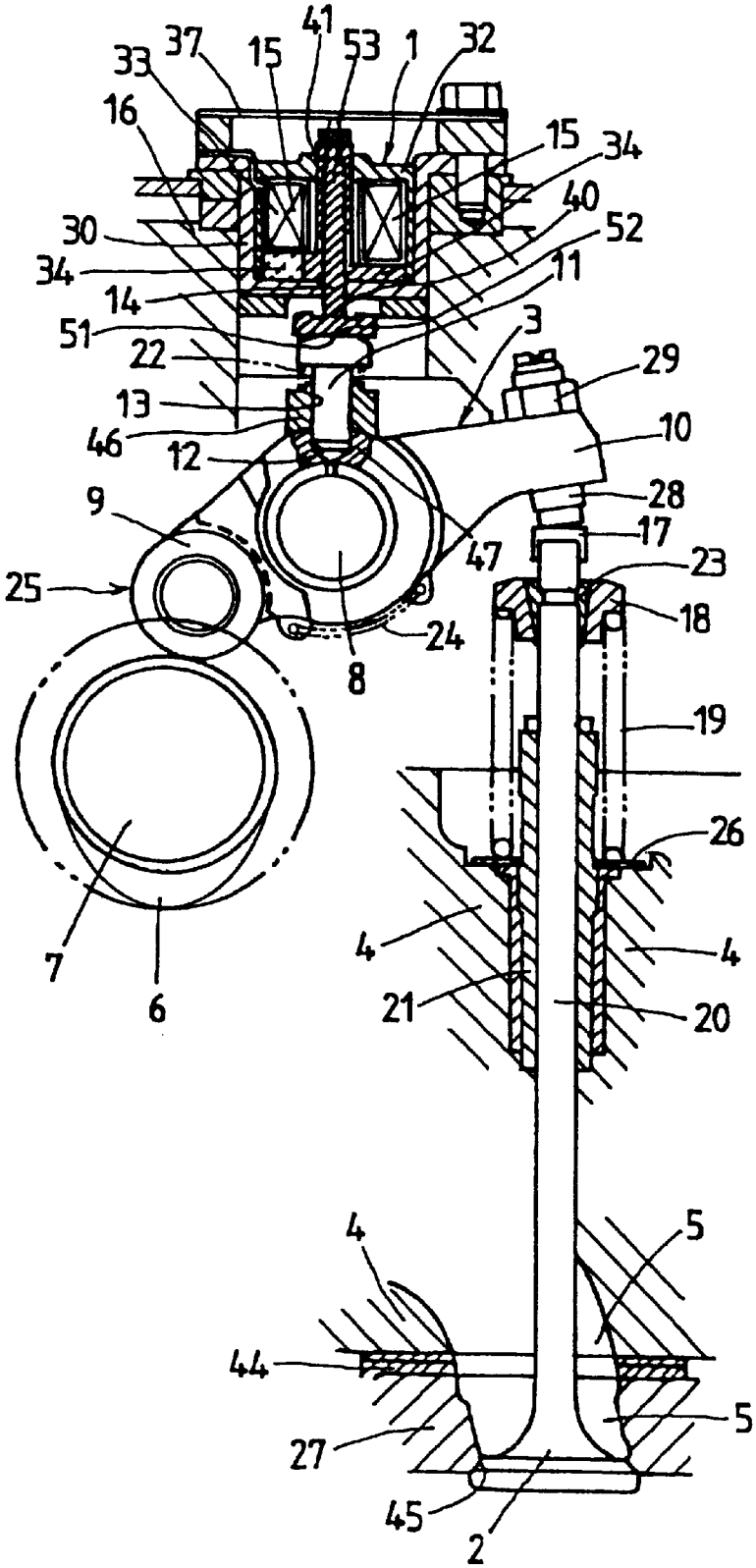
FIG. 4 is an explanatory diagram showing the state where the leading end portion of a pin is inserted into an engagement hole of a second rocker arm.

At the time of the engine at a high speed and under a high load, as shown in FIG. 4, the electromagnet of the electromagnetic drive device 1 is excited. When the electromagnet of the electromagnetic drive device 1 is excited, the cylindrical plunger 41 of the movable element 14 is attached by the magnetic pole, i.e., the upper end of the cylindrical portion 34*b* of the lower yoke 34 so that the movable element 14 is lifted to push down the pin 11. At this time, the pin 11 slides down in the pin guide hole 13 formed in the first rocker arm 9 and comes into engagement with the engagement hole 12 of the second rocker arm 10.

Figure 5:
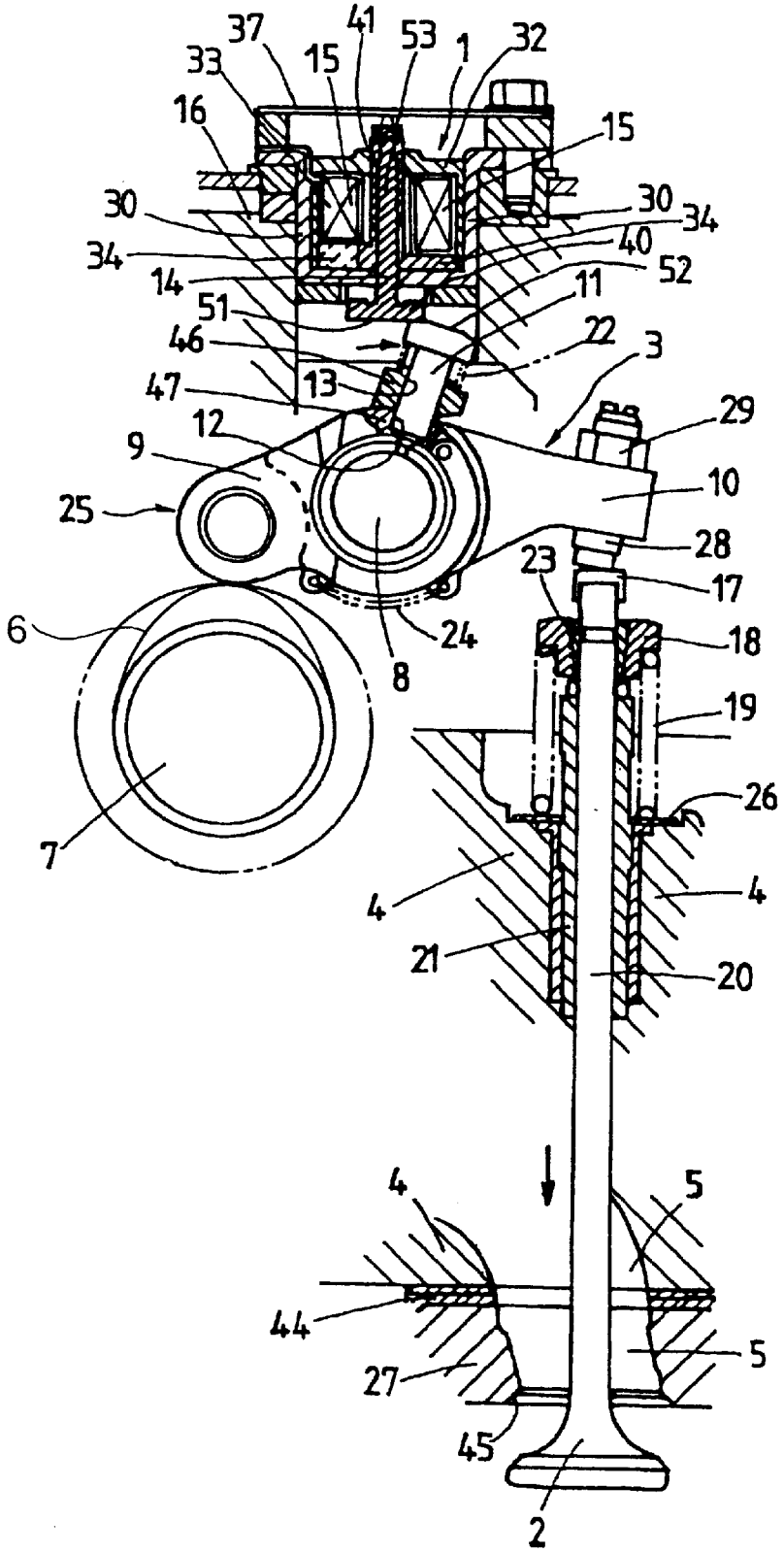
FIG. 5 is an explanatory diagram showing the state where first and second rocker arms rock together to open intake/exhaust valves.

When the pin 11 engages at its leading end portion with the engagement hole 12 of the second rocker arm 10, the first rocker arm 9 and the second rocker arm 10 come into the integrally connected state. When the first rocker arm 9 and the second rocker arm 10 are thus fixed, not only the first rocker arm 9 but also the second rocker arm 10 is rocked by the cam 6, as shown in FIG. 5, so that the intake/exhaust valve 2 is pushed down through the valve adjusting screw 28 fixed in the second rocker arm 10, to open the intake/exhaust port 5.

Figure 6:
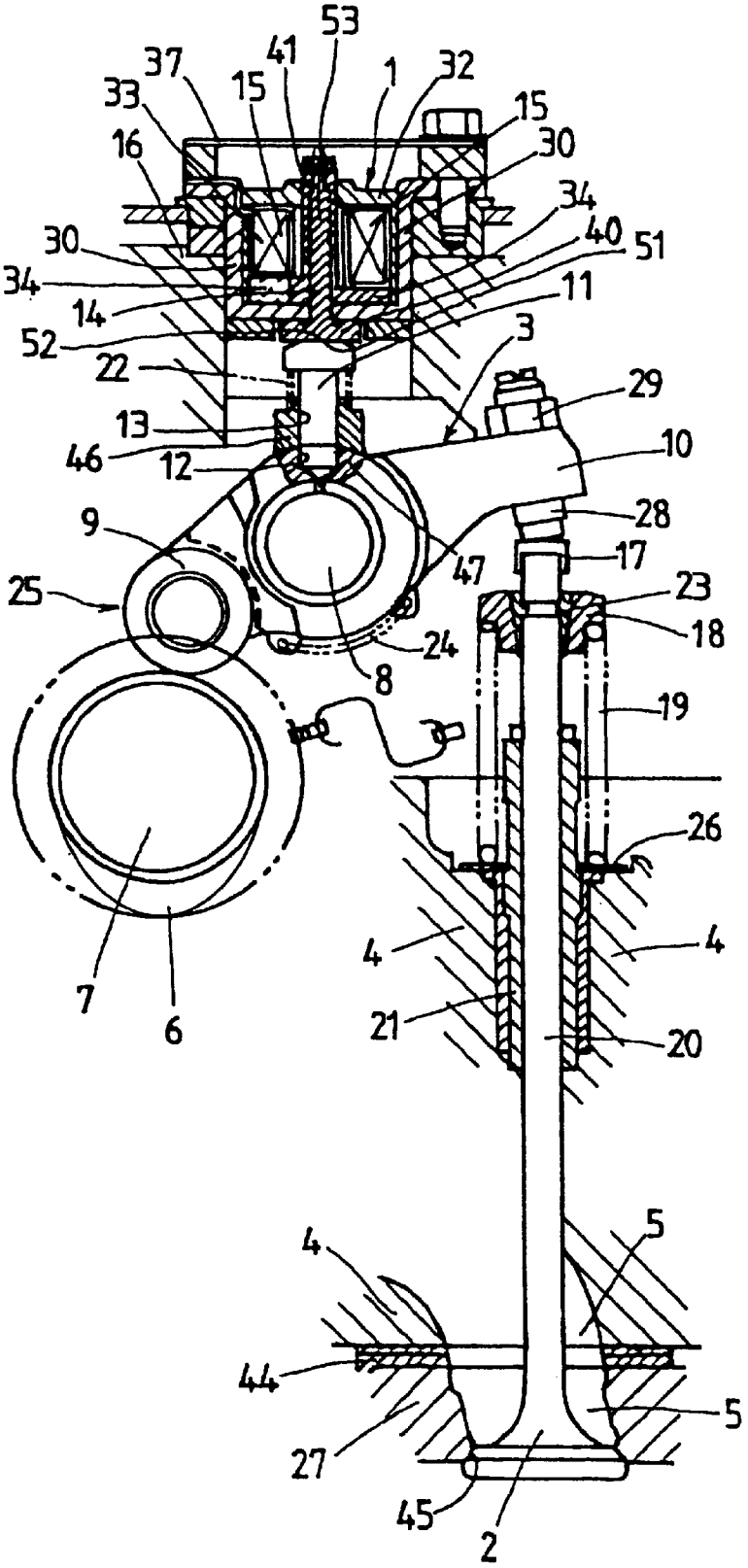
FIG. 6 is an explanatory diagram showing the state where the leading end portion of the pin is retracted from the engagement hole of the second rocker arm.

At an idling time or at a running time at a low speed/under a low load of the engine, on the other hand, the electromagnet of the electromagnetic drive device 1 of the selected cylinder is unexcited to the inactive state. When the electromagnet of the electromagnetic drive device 1 is thus unexcited, the pin 11 is returned upward by the return spring 22, as shown in FIG. 6, so that the movable element 14 of the electromagnetic drive device 1 is returned upward by the return of the pin 11.

Figure 7:
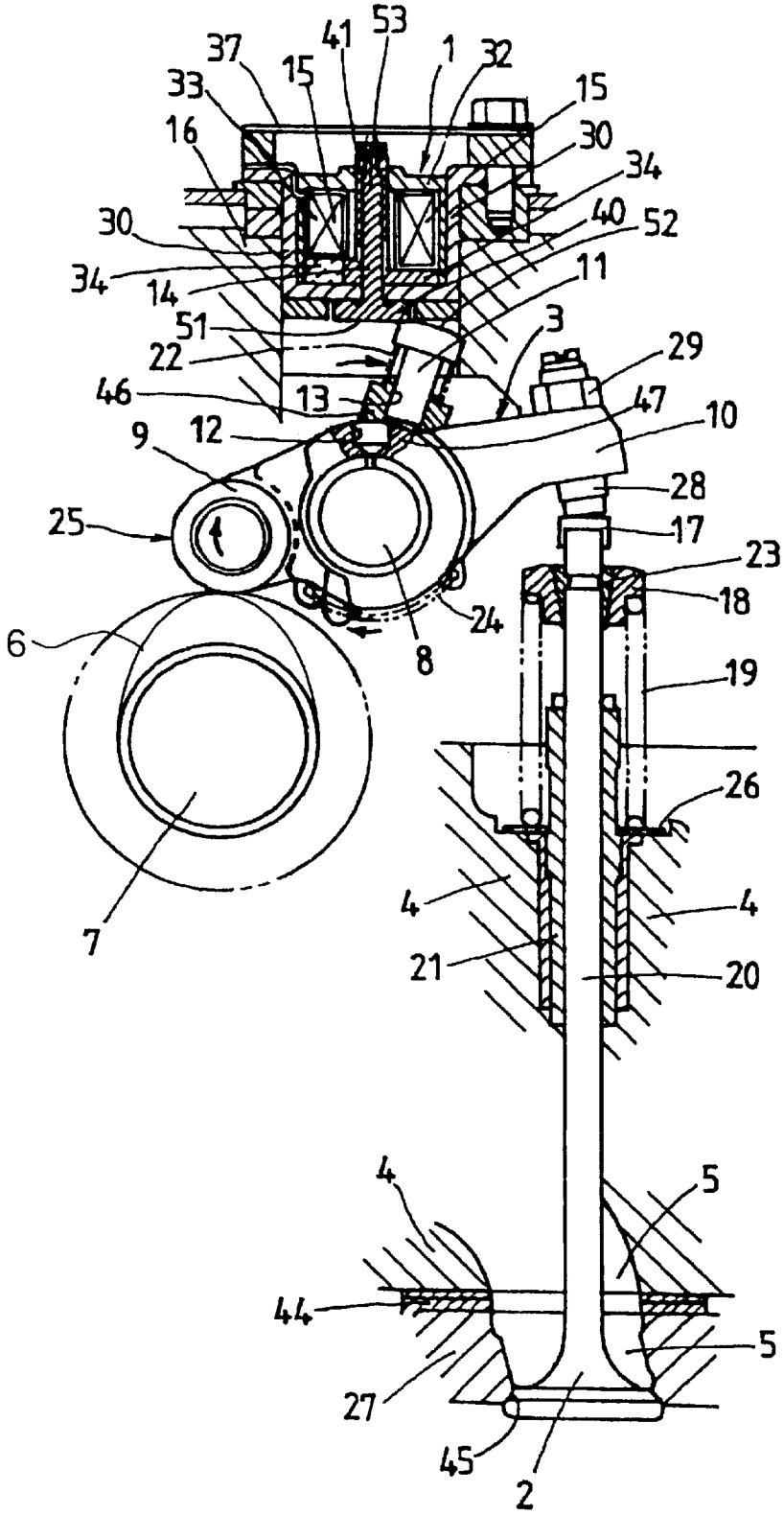
FIG. 7 is an explanatory diagram showing the state where only the first rocker arm is rocked by a cam while leaving the intake/exhaust valves unopened.

The leading end portion of the pin 11 is retracted from the engagement hole 12 of the second rocker arm 10 by the return of the pin 11 to disconnect the first rocker arm 9 and the second rocker arm 10. When these first and second rocker arms 9 and 10 are thus disconnected, the second rocker arm 10 is not rocked even if the first rocker arm 9 is rocked by the cam 6, as shown in FIG. 7, so that it is held at the original position by the return spring 24. As a result, the valve adjusting screw 28 fixed in the second rocker arm 10 does not push down the intake/exhaust valve 2 so that the intake/exhaust port 5 is held in the closed state.

What is claimed is:

1. A valve resting mechanism for a cylinder control type engine, the engine comprising:

a cylinder head fixed on a cylinder block having a plurality of cylinders;

an intake/exhaust valve to open/close an intake/exhaust port formed in said cylinder head; and a cam type valve actuating mechanism disposed over said cylinder head to actuate said intake/exhaust valve to open/close the intake/exhaust port, said cam type valve actuating mechanism comprising:

a cam formed on a camshaft rotatable according to a rotation of the engine, and a rocker arm adapted to rock on a rocker arm shaft in accordance with a rotation of said cam, to open/close said intake/exhaust valve, said rocker arm comprising a first rocker arm and a second rocker arm to rock independently of each other on said rocker arm shaft, said first rocker arm to rock in response to the rotation of said cam, said second rocker arm to open/close said intake/exhaust valve, said first and second rocker arms respectively comprising first and second individual engagement portions engaging with a pin slidably moved by an electromagnetic drive device; and a rocking motion being transmitted from said first rocker arm to said second rocker arm in an engaged state in which said pin is engaged by said first and second engagement portions, whereas the rocking motion is not transmitted from said first rocker arm to said second rocker arm in a disengaged state in which said pin is not engaged by the second engagement portion, wherein said electromagnetic drive device comprises:

a movable element to slide said pin in an axial direction of said pin;

a stator to form an electromagnet; and a clearance between said movable element and said stator to limit a sliding of said movable element in the axial direction, the valve resting mechanism comprising a rocking fulcrum of said rocker arms;

said pin and said movable element to slide toward a center of the rocking fulcrums of said rocker arms from sliding faces of said engagement portions.

2. A valve resting mechanism for a cylinder control type engine according to claim 1, wherein said first rocker arm and said second rocker arm each comprise rocker arm return springs to rock while following movements of said cam and said intake/exhaust valve at all times.

3. A valve resting mechanism for a cylinder control type engine, the engine comprising:

a cylinder head fixed on a cylinder block having a plurality of cylinders;

an intake/exhaust valve to open/close an intake/exhaust port formed in said cylinder head; and a cam type valve actuating mechanism disposed over said cylinder head to actuate said intake/exhaust valve to open/close the intake/exhaust port, said cam type valve actuating mechanism comprising:

a cam formed on a camshaft rotatable according to a rotation of the engine, and a rocker arm adapted to rock on a rocker arm shaft in accordance with a rotation of said cam, to open/close said intake/exhaust valve, said rocker arm comprising a first rocker arm and a second rocker arm to rock independently of each other on said rocker arm shaft, said first rocker arm to rock in response to the rotation of said cam, said second rocker arm to open/close said intake/exhaust valve, said first and second rocker arms respectively comprising first and second engagement portions engaging with a pin slidably moved by an electromagnetic drive device; and a rocking motion being transmitted from said first rocker arm to said second rocker arm in an engaged state in which said pin is engaged by said first and second engagement portions, whereas the rocking motion is not transmitted from said first rocker arm to said second rocker arm in a disengaged state in which said pin in not engaged by the second engagement portion, wherein one of said first and second engagement portions is formed at a boss portion of said first rocker arm by a pin guide hole to guide said pin slidably, whereas the other one of the first and second engagement portions is formed at a boss portion of said second rocker arm by an engagement hole to be engaged by said pin, the valve resting mechanism comprising:

a return spring arranged between a head of said pin and said boss portion of the first rocker arm, said pin being inserted at all times into said pin guide hole of said first rocker arm and being biased in a direction to come out of said engagement hole of said second rocker arm by the return spring.

4. A valve resting mechanism for a cylinder control type engine according to claim 3, wherein said electromagnetic drive device comprises:

a movable element to slide said pin in an axial direction of said pin;

a stator to form an electromagnet; and a clearance between said movable element and said stator to limit a sliding of said movable element in the axial direction.

5. A valve resting mechanism for a cylinder control type engine according to claim 4, wherein the sliding stroke of said pin is controlled by the sliding extent of said movable element.

6. A valve resting mechanism for a cylinder control type engine according to claim 4, wherein said pin and said movable element are mutually slidable toward the center of the rocking fulcrum of said rocker arm from the sliding faces of said engagement portions.

7. A valve resting mechanism for a cylinder control type engine according to claim 4, wherein said pin rocks while engaging at all times with said engagement portion of said first rocker arm and is brought by the sliding motion of said movable element into rocking engagement with said engagement portions of both said first and second rocker arms.

8. A valve resting mechanism for a cylinder control type engine according to claim 3, wherein said first rocker arm and said second rocker arm each comprise rocker arm return springs to rock while following movements of said cam and said intake/exhaust valve at all times.

9. A valve resting mechanism for a cylinder control type engine according to claim 3, wherein the engagement/disengagement of said rocker arm and said second rocker arm, disposed at individual ones of the cylinders to act independently of each other with respect to the individual cylinders, are individually controlled according to a running state of the engine.

10. A valve resting mechanism for a cylinder control type engine according to claim 3, wherein said stator of said electromagnetic drive device comprises:

a case fixed on said cylinder head through a bracket;

a yoke arranged in said case; and an exciting coil arranged in said yoke.

11. A valve resting mechanism for a cylinder control type engine according to claim 1, wherein the engagement/disengagement of said first rocker arm and said second rocker arm, disposed at individual ones of the cylinders to act independently of each other with respect to the individual cylinders, are individually controlled according to a running state of the engine.

12. A valve resting mechanism for a cylinder control type engine according to claim 1, wherein said stator of said electromagnetic drive device comprises:

a case fixed on said cylinder head through a bracket;

a yoke arranged in said case; and an exciting coil arranged in said yoke.

* * * * *

UNITED STATES PATENT AND TRADEMARK OFFICE

CERTIFICATE OF CORRECTION

PATENT NO. : 6,412,461 B2
DATED : July 2, 2002
INVENTOR(S) : Kenro Nakashima

It is certified that error appears in the above-identified patent and that said Letters Patent is hereby corrected as shown below:

Title page,
Item [73], Assignee, should read as follows:
-- Isuzu Motors Ltd., Tokyo, Japan --

Signed and Sealed this

Twenty-second Day of October, 2002

*Attest:*

*Attesting Officer*

JAMES E. ROGAN
*Director of the United States Patent and Trademark Office*